US007104101B1

(12) United States Patent
Berger et al.

(10) Patent No.: US 7,104,101 B1
(45) Date of Patent: Sep. 12, 2006

(54) ROLL STAND

(75) Inventors: Bernd Berger, Kaarst (DE); Heinrich Schulte, Arnsberg (DE); Damian Cöppicus, Menden (DE)

(73) Assignee: Sundwig GmbH, Hemer (DE)

( * ) Notice: Subject to any disclaimer, the term of this patent is extended or adjusted under 35 U.S.C. 154(b) by 62 days.

(21) Appl. No.: 10/088,277

(22) PCT Filed: Aug. 1, 2000

(86) PCT No.: PCT/EP00/07431

§ 371 (c)(1),
(2), (4) Date: Jun. 19, 2002

(87) PCT Pub. No.: WO01/21334

PCT Pub. Date: Mar. 29, 2001

(30) Foreign Application Priority Data

Sep. 17, 1999 (DE) ..... 199 44 612

(51) Int. Cl.
*B21B 13/14* (2006.01)

(52) U.S. Cl. ..... 72/243.4; 72/238

(58) Field of Classification Search ..... 72/243.4, 72/241.6, 243.2; 403/331, 381
See application file for complete search history.

(56) References Cited

U.S. PATENT DOCUMENTS

| | | | | |
|---|---|---|---|---|
| 3,535,204 | A * | 10/1970 | Truxa | 162/352 |
| 4,212,504 | A * | 7/1980 | Krylov et al. | 384/120 |
| 4,531,394 | A * | 7/1985 | Turley et al. | 72/238 |
| 4,563,888 | A | 1/1986 | Bald et al. | |
| 4,614,103 | A | 9/1986 | Takagi et al. | |
| 5,119,656 | A * | 6/1992 | Kobayashi et al. | 72/13.4 |
| 6,003,355 | A * | 12/1999 | Yasuda et al. | 72/243.4 |

FOREIGN PATENT DOCUMENTS

| | | | |
|---|---|---|---|
| DE | 359 459 | | 11/1980 |
| DE | 32 00 654 | A1 | 8/1982 |
| DE | 33 24 562 | A1 | 1/1985 |
| DE | 29 19 105 | C2 | 3/1985 |
| EP | 0149247 | A2 * | 7/1985 |
| EP | 06142407 | | 5/1994 |
| JP | 63063503 | | 3/1988 |
| JP | 01262005 | | 10/1989 |
| JP | 08117823 | A * | 5/1996 |

* cited by examiner

*Primary Examiner*—Lowell A. Larson
(74) *Attorney, Agent, or Firm*—Proskauer Rose LLP

(57) ABSTRACT

The invention relates to a roll stand comprising a pair of work rolls 1, 2 for rolling a metal strip B, comprising back-up rolls 8, 9, 10, 11 which provide lateral support to their respectively allocated work rolls 1, 2, with support force directed towards the work rolls 1, 2 being able to be applied to said back-up rolls by means of a force generation device, and comprising support rolls or intermediate rolls 3, 4 which are borne by a chock which can be slid into the roll stand W1, W2 in the direction of the longitudinal axis of said chock 7, and wherein said chock can be withdrawn from said roll stand, with each support roll or intermediate roll supporting an associated work roll 1, 2 in a direction which is essentially perpendicular to the direction of movement of the metal strip B. In such a roll stand, changing of the rolls can be carried out more quickly and easily in that the back-up rolls 8, 9, 10, 11 can be positioned from an idle position in which they are arranged outside the region where the chock 7 of the support roll or intermediate roll 3, 4 moves during slide-in or withdrawal, to an operating position in which they rest against the work roll 1, 2.

8 Claims, 6 Drawing Sheets

ROLL STAND

BACKGROUND OF THE INVENTION

The invention relates to a roll stand with a pair of work rolls for rolling a metal strip, comprising back-up rolls which provide lateral support to their respectively allocated work rolls, with support force directed towards the work rolls being able to be applied to said back-up rolls by means of a force generation device, and comprising support rolls or intermediate rolls which are borne by a chock, which can be slid into said roll stand in the direction of the longitudinal axis of said chock and wherein said chock can be withdrawn from the roll stand, with each support roll or intermediate roll supporting an associated work roll in a direction which is essentially perpendicular to the direction of movement of the metal strip.

In a roll stand known from DE 29 19 105 C2, each of the work rolls is supported on a support roll via an intermediate roll. At the same time, two back-up rolls are associated with each work roll, with said back-up rolls being arranged so as to rest against the respective work roll laterally at opposite sides. In the known roll stand, the support roll and the intermediate roll are held in a chock. At the same time beam-shaped support members for the back-up rolls are attached in an articulating manner. The lateral dimensions of the support member are limited to such an extent that the support members with the back-up rolls do not laterally protrude from the chock. In this way the chock constitutes a constructional unit together with the support roll, the intermediate roll and the back-up rolls as well as the associated support elements and bearing elements. For the purpose of maintenance and repair, this constructional unit can easily be withdrawn from the roll stand and subsequently can be slid back into place again. In the known device, the required back-up forces are provided by means of manually adjustable bolts which laterally impinge on the support members, without being coupled to said support members.

The known embodiment of a six-roll stand as explained above, is associated with the advantage that the constructional unit comprising the chock and the components borne by it, is of compact design. This embodiment makes it possible to change this constructional unit within a short time. However, with the known roll stand it has been shown to be difficult in practical application to quickly exchange for example a support roll or one of the back-up rolls, because this always necessitates extensive installation work.

Apart from the state of the art as explained above, from the Austrian patent specification AT 359 459 a roll stand is known which provides three back-up rolls to support the work roll. The back-up rolls themselves are laterally supported by hydrostatic bearings, with three of said bearings being arranged, regularly spaced apart, along the respective work roll. Also, hydraulic cylinders are provided to apply the required support forces.

This roll stand known from AT 359 459 is associated with the problem of disassembly of the back-up rolls as well as the problem of adjusting the support forces in line with the respective loads occurring during rolling.

In a further development of the previously explained state of the art, as known from DE 33 24 562 C2, the back-up rolls are held in an articulated manner via a support member which supports the support rolls and intermediate rolls. As is the case with the state of the art explained in the introduction, in this further development too, exchanging individual rolls is difficult and time-consuming.

SUMMARY OF THE INVENTION

It is thus the object of the invention to improve a roll stand of the type explained above, such that changing the rolls of the stand can be carried out more quickly and easily than is the case in the state of the art.

Starting with a roll stand of the type mentioned in the introduction, this object is met in that the back-up rolls can be positioned from an idle position in which they are arranged outside the region where the chock of the support roll or intermediate roll moves during slide-in or withdrawal, to an operating position in which they rest against the work roll.

According to the invention, the back-up rolls can be moved from the movement region of the chock carrying the support roll and if need be further rolls. In this way, the chock with the rolls held therein, can be removed from the roll stand, serviced and slid-in again, all independently of the back-up rolls. Similarly it is possible to service or replace the back-up rolls independently of the rolls of the chock.

The invention provides a further significant advantage in that it is no longer necessary to attune the spatial arrangement of the rolls borne by the chock to the necessity of an articulated bearing arrangement of the back-up rolls. The design space saved in this way makes it possible to provide support rolls, intermediate rolls and work rolls of increased diameter. For example, larger roll diameters can be provided compared to the state of the art, so that there is a larger wear area, which means that respective rolls have a better service life.

Furthermore, in line with their exposure to loads from the associated work roll, the intermediate rolls can be whipped so that the dimensional accuracy of the roll gap is further improved.

While the state of the art always maintains a constructional unit comprising the rolls and the chock, the invention moves away from this concept and thus results in the individual rolls of a roll stand according to the invention being quickly and easily accessible so that their service or repair can take place more quickly and more easily.

The invention can be achieved simply and economically in that the force generation device moves the back-up roll from the idle position into the operating position. In this embodiment of the invention, the force generation device not only provides the support forces but at the same time also serves as an actuating device by means of which the back-up rolls can be moved to the work rolls or retracted from them.

The required support forces can be generated with modest space and power requirements in that the force generation device is a hydraulically or pneumatically operable cylinder. By having one or several such cylinders acting upon each back-up roll, the forces required for supporting the back-up roll can be delivered precisely and with short reaction times. This makes it possible to influence the roll gap between the work rolls by applying precisely defined support forces to the back-up rolls.

A further advantageous embodiment of the invention provides for the respective back-up roll to be borne by a support beam and for the force generation device to act upon this beam. By having the force generation devices act upon the beam, support forces can be applied to the back-up rolls evenly without any sudden abrupt changes being experienced. This applies in particular where the bearing arrangement provides for the back-up roll to be supported, at least in certain sections along its longitudinal extension, by the support beam. If force generation devices are used which act at points upon the back-up rolls (for example actuating cylinders or comparable units which transfer the support forces via a plunger) then with the application of a support beam, according to the invention, a smaller number of force generation devices is sufficient, when compared to the state of the art, to achieve the desired gradual transition of the load generated by the individual devices. Furthermore, the use of the support beam makes possible a targeted whipping of the work roll and/or back-up roll.

A first bearing arrangement consists of roller bearings which are arranged so as to be regularly spaced apart along the back-up roll. As an alternative, the bearing arrangement can however also be provided by at least one hydrostatic bearing. Irrespective of the type of bearing arrangement, said bearing arrangement can be divided into individual segments, arranged along the respective back-up roll, said segments advantageously being associated with the respective force generation devices.

In so far as the support beam is divided into two detachably interconnected components in longitudinal direction of the back-up roll, wherein the first component bears the back-up roll and wherein the second component is coupled to the force generation device, the back-up roll borne by the respective support beam can be replaced particularly simply and quickly. This applies in particular if the first component which holds the back-up roll, is held to the second component of the support beam so as to be slidable along the longitudinal direction of said first component.

BRIEF DESCRIPTION OF THE DRAWINGS

Below, the invention is explained in more detail by means of a drawing showing an embodiment. The following are shown diagrammatically.

DETAILED DESCRIPTION OF THE INVENTION

Figure 1:
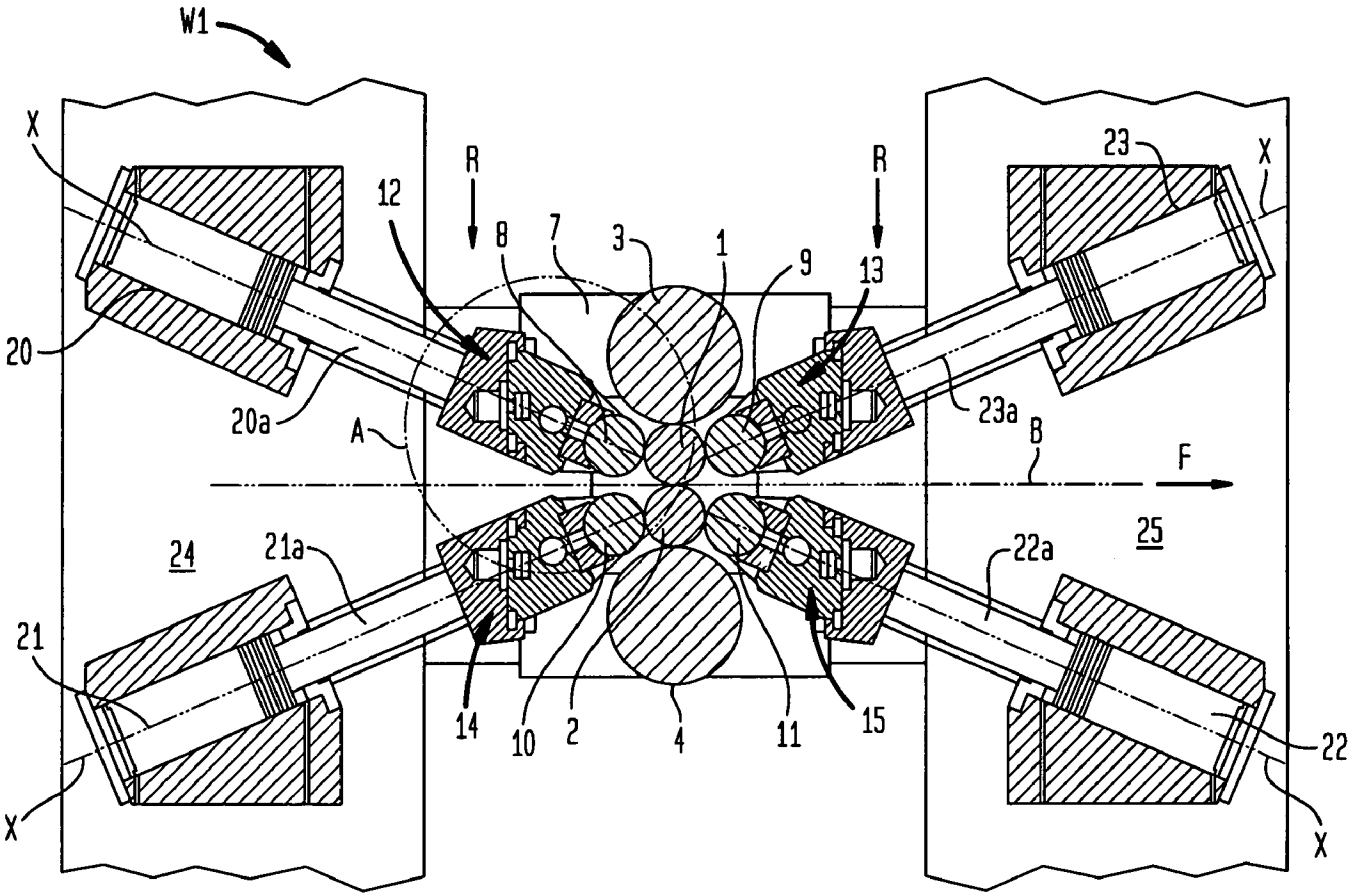
FIG. 1 a section view of a roll stand in a first operating position in a section along the direction of conveyance of the rolled metal strip.
Figure 1A:
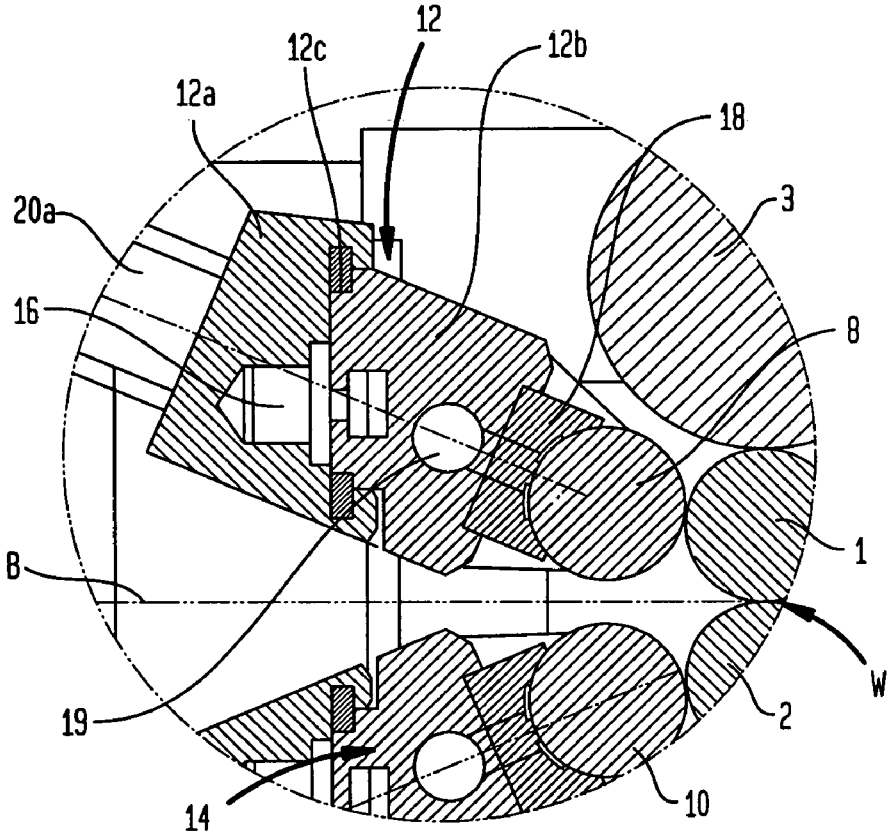
FIG. 1*a* an enlarged view of a section A of FIG. 1.

In the figures, elements with the same function have the same reference characters.

Each of the roll stands W1, W2 has two work rolls 1, 2. In vertical direction each work roll 1, 2 is supported by an intermediate roll 3, 4 against a support roll (not shown) whose axis of rotation is in the same plane as the axes of rotation of the work rolls 1, 2 and the intermediate rolls 3, 4. The intermediate rolls 3, 4 are held in a chock 7 and the support rolls (not shown) are held in a chock of their own (also not shown), while the work rolls 1, 2 are loosely held in the roll stand W1, W2. Between the work rolls 1, 2 there is a roll gap W in which a metal strip B, conveyed in the direction of conveyance F, is cold rolled.

The chock 7 is slidably held on a slideway (not shown); said chock can be withdrawn from the respective roll stand W1, W2 along its longitudinal direction, parallel to the axes of rotation of the work rolls, intermediate rolls and support rolls.

Each work roll 1, 2 comprises two back-up rolls 8, 9; 10, 11 of which one side is associated with the work roll 1, 2. In each case the back-up rolls 8, 9; 10, 11 are borne by a support beam 12, 13, 14, 15.

Each of the support beams 12, 13, 14, 15 is divided into two components 12*a*, 12*b*, wherein the plane of osculation is arranged vertically, extending parallel to the plane of the axes of rotation of the work rolls 1, 2, the intermediate rolls 3, 4 and the support rolls (not shown). The second component 12*b* of the respective support beam 12, 13, 14, 15 bears the back-up roll 8, 9, 10 or 11, associated with said support beam 12, 13, 14, 15. By way of a guide rail 12*c* at the respective first component 12*a* and by way of attachment bolt 16, the respective second component 12*b* is held to the first component 12*a* so as to be slidable in longitudinal direction, so that it can be withdrawn from the respective roll stand W1, W2 together with the back-up roll 8, 9, 10, or 11 borne by it.

Figure 2:
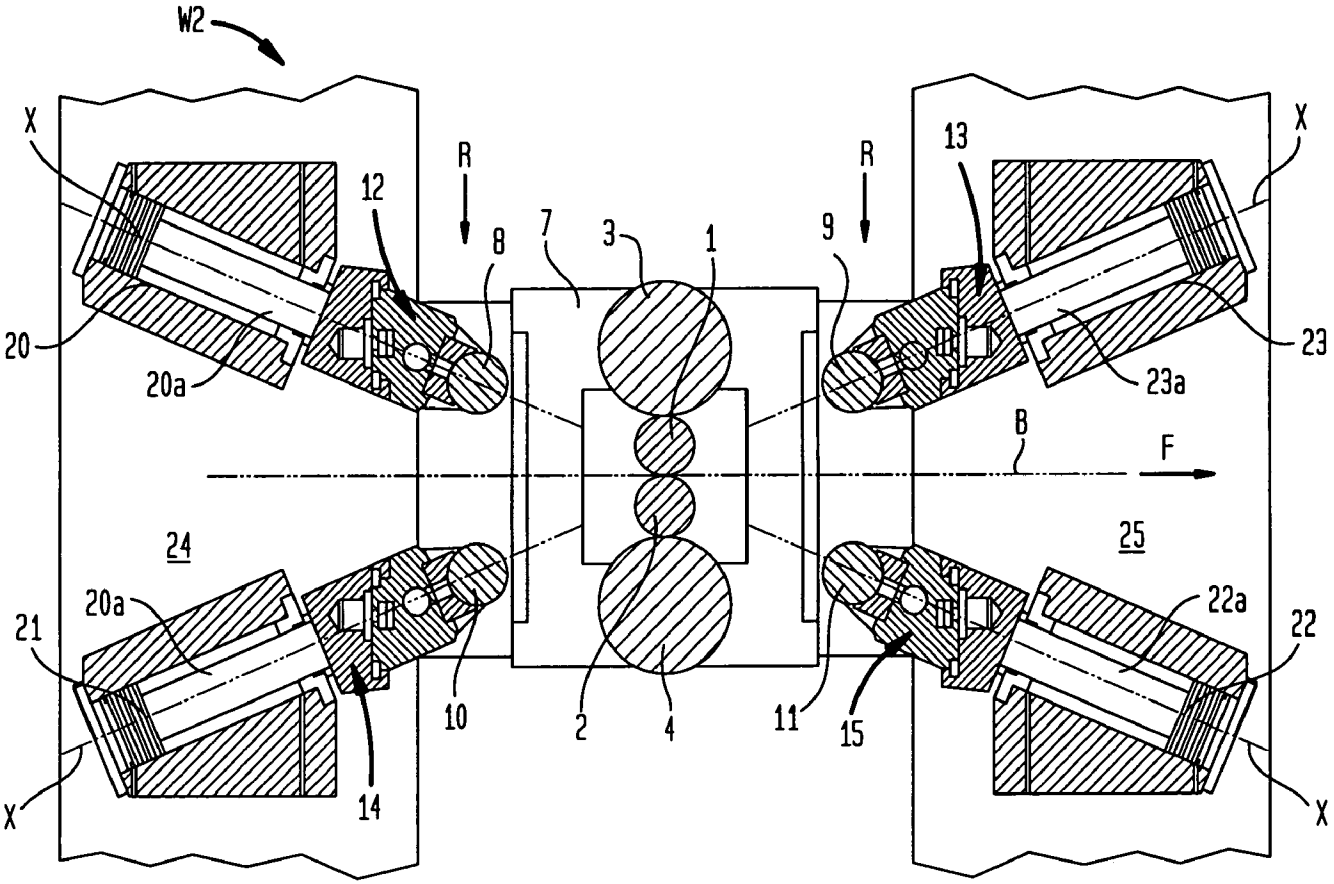
FIG. 2 the roll stand according to FIG. 1 in a second operating position.
Figure 3:
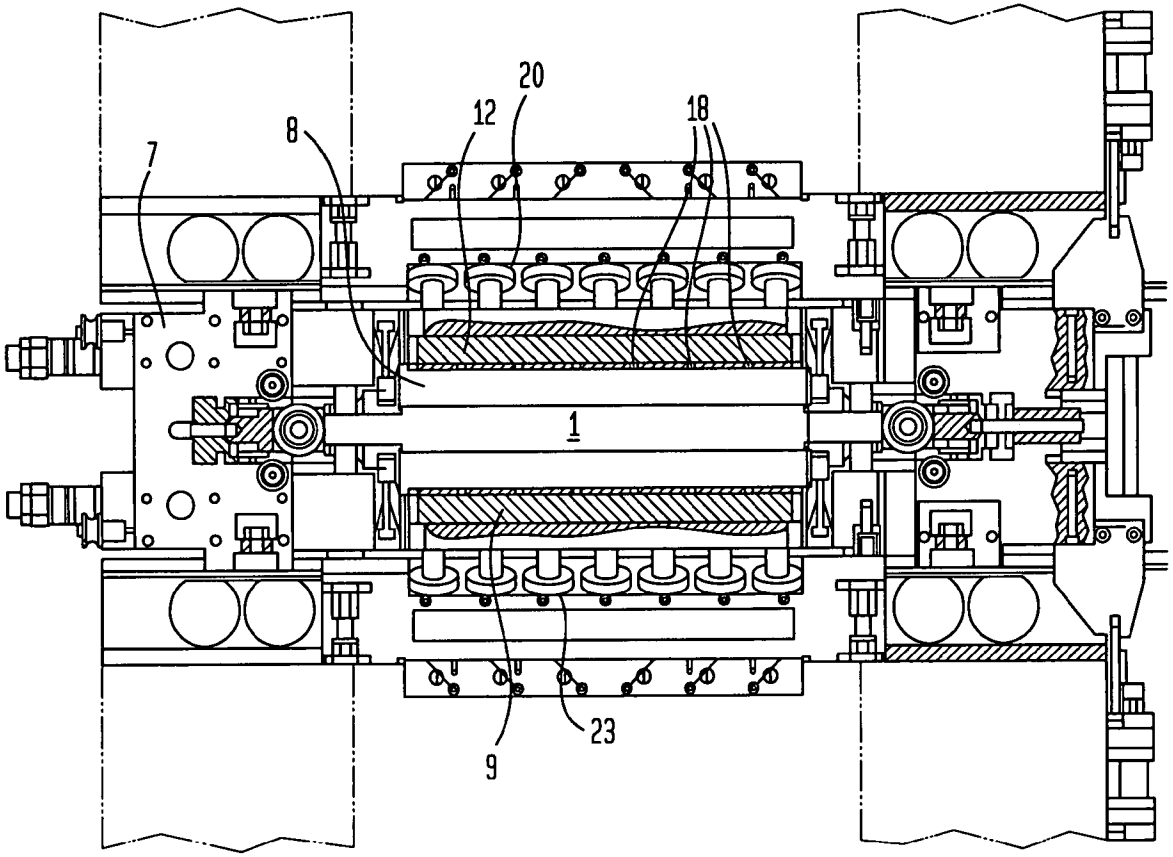
FIG. 3 the roll stand according to FIG. 1 in a section parallel to the direction of conveyance of the rolled strip.

In the embodiment according to FIGS. 1, 2 and 3, for lateral support of the back-up rolls 8, 9, 10 or 11, along the back-up rolls 8, 9, 10 or 11, hydrostatic bearings 18 are arranged so as to be regularly spaced apart. The bearings 18 are supported by the respective support beams 12, 13, 14, 15 and are supplied with pressure fluid by way of a supply line 19 in the second component 12*b* of the respective support beam 12, 13, 14, 15.

Figure 4:
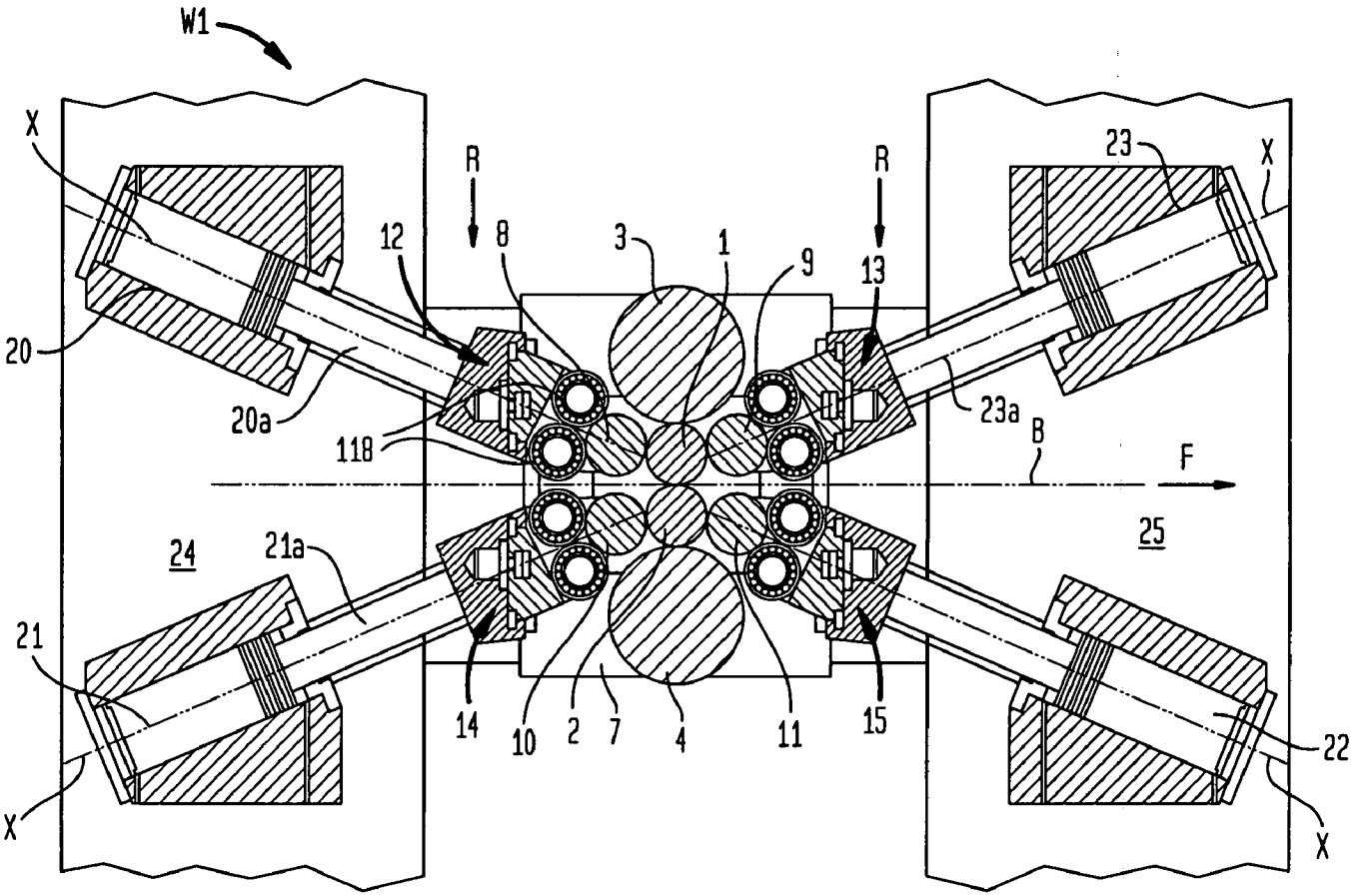
FIG. 4 a section view of a second roll stand in a first operating position in a section along the direction of conveyance of the rolled metal strip.
Figure 5:
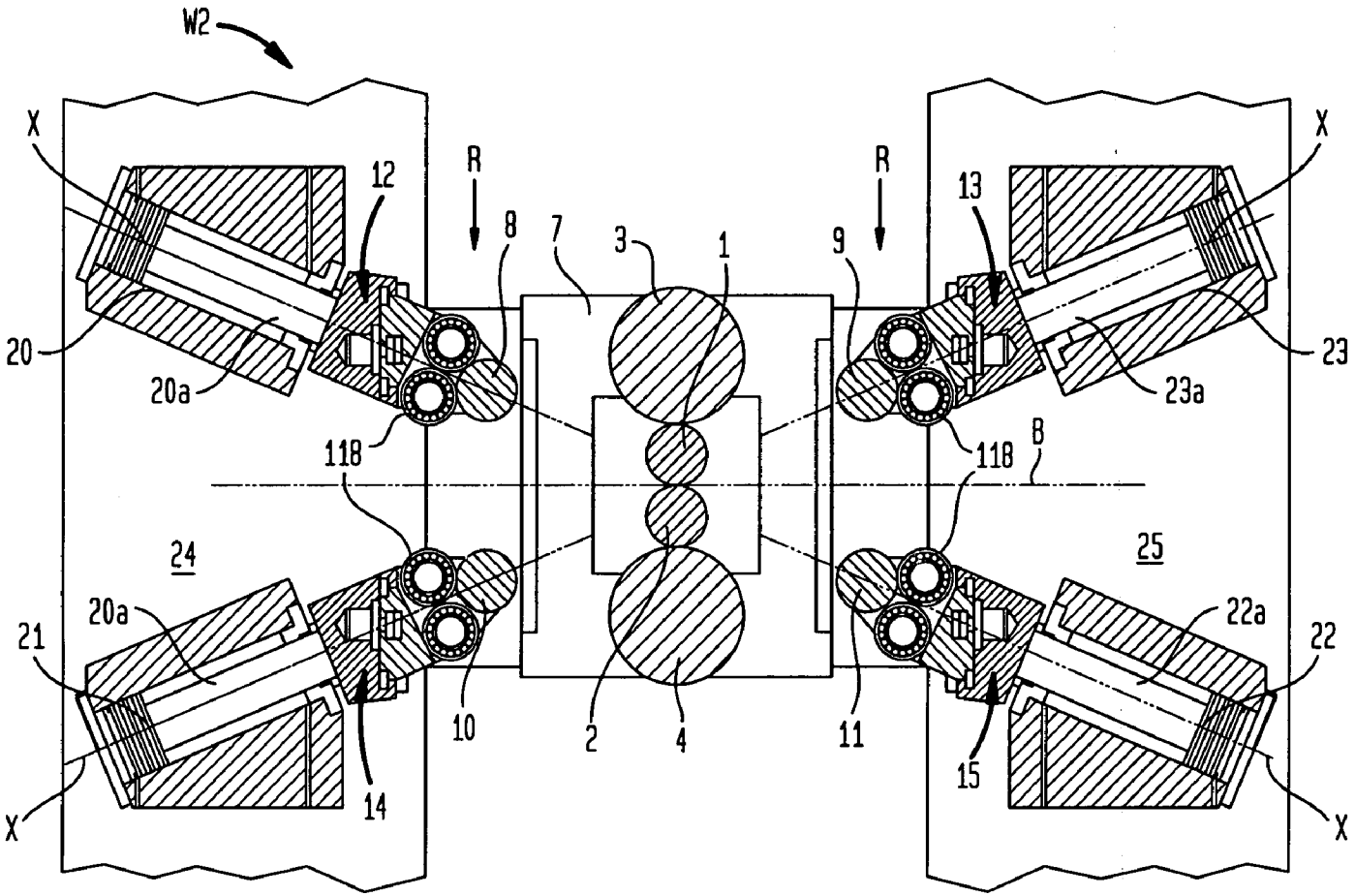
FIG. 5 the roll stand according to FIG. 4 in a second operating position.

In the embodiment according to FIGS. 4, 5, roller bearings 118 are arranged at regular spacing at the support beams 12, 13, 14, 15, to provide lateral support of the back-up rolls 8, 9, 10 or 11, along the back-up rolls 8, 9, 10 or 11. The roller bearings 118 are also supported by the respective support beam 12, 13, 14, 15.

Each support beam 12, 13, 14, 15 is associated with several hydraulically operated actuating cylinders 20, 21, 22, 23, regularly spaced apart along the respective support beam 12, 13, 14, or 15, said actuating cylinders being attached at the pillars 24 or 25 of the roll stand W1, W2, said pillars being arranged on the side of the chock 7. The pistons 20*a*, 21*a*, 22*a*, 23*a* of the actuating cylinders 20, 21, 22, 23 are coupled to the first component 12*a* of the respective support beam 12, 13, 14 or 15. Each of the movement axes X of the pistons 20*a*, 21*a*, 22*a*, 23*a* is arranged so as to be inclined in the direction of the roll gap w.

There is a free space R between the respective place of attachment of the actuating cylinders 20, 21, 22, 23 and the space in which the chock 7 is moved during sliding in or withdrawing. The depth of this free space R and the actuating path of the pistons 20*a*, 21*a*, 22*a*, 23*a* are such that when the pistons 20*a*, 21*a*, 22*a*, 23*a* are fully withdrawn, the support beams 12, 13, 14, 15 borne by them, including the respective back-up rolls 8, 9, 10 or 11 held on them, are situated in said free space R (FIG. 2, FIG. 5). In this position of the pistons 20*a*, 21*a*, 22*a*, 23*a* and the interconnected support beams 12, 13, 14, 15, the chock 7 including the intermediate rolls and support rolls 3, 4 (not shown) held in said chock 7, can be withdrawn from the roll stand W1 or W2 without there being any danger of a collision with the back-up rolls 8, 9, 10, 11.

In order to exchange the back-up rolls 8, 9, 10, 11, the respective second component 12*b* is withdrawn along the guide rail 12*c*, from the respective first component 12*a* of the support beam, said first component of the support beam 12, 13, 14, 15 being connected to the respectively associated piston 20*a*, 21*a*, 22*a* or 23*a*. This can take place with the chock 7 withdrawn. To this effect, the back-up rolls 8, 9, 10, 11 with the support beams 12, 13, 14, 15 are moved to the respective free space R so that the chock 7 can be withdrawn from the roll stand W1 or W2 without hindrance.

As an alternative, the back-up rolls 8, 9, 10, 11 can also be withdrawn from the roll stand W1 or W2 together with the chock 7. To this effect the support beams 12, 13, 14, 15 are moved to a position in which their respective guide rails 12*c* are arranged so as to be flush with the respective outermost edge of the chock 7. When withdrawing the chock 7, the components 12*a* of the support beams 12, 13, 14, 15 and with them the respective back-up rolls 8, 9, 10, 11 are withdrawn from the roll stand W1, W2 together with the chock 7. In this way, the chock 7 constitutes an assembly and disassembly aid which makes it possible to do without a special auxiliary device of this type.

In the case of back-up rolls 8, 9, 10, 11 put in position against the work roll 1, 2, the actuating cylinders 20, 21, 22, 23 generate the support force by means of which the back-up rolls 8, 9, 10, 11 are supported on their respective side facing away from the respective work roll 1, 2, by means of hydrostatic bearings 18 or roller bearings 118. The support forces generated by the actuating cylinders 20, 21, 22, 23 along the respective support beam 12, 13, 14, 15, can be set such that a particular geometric shape of the roll gap W is achieved by corresponding whipping of the respective back-up rolls 8, 9, 10, 11 or work rolls 1, 2.

LIST OF REFERENCE CHARACTERS

| | |
|---|---|
| W1, W2 | Roll stands |
| 1, 2 | Work rolls |
| 3, 4 | Intermediate rolls |
| 7 | Chock |
| 8, 9, 10, 11 | Back-up rolls |
| 12, 13, 14, 15 | Support beams |
| 12a, 12b | Components of the support beams 12, 13, 14, 15 |
| 12c | Guide rail |
| 16 | Attachment bolt |
| 18 | Hydrostatic bearings |
| 19 | Supply line |
| 20, 21, 22, 23 | Actuating cylinders |
| 20a, 21a, 22a, 23a | Pistons |
| 24, 25 | Pillars of the roll stand W1, W2 |
| 118 | Roller bearings |
| B | Metal strip |
| F | Direction of conveyance |
| R | Free space |
| W | Roll gap |
| X | Movement axis of the pistons 20a, 21a, 22a, 23a |

What is claimed is:

1. A roll stand comprising:

(a) a pair of work rolls for rolling a metal strip;

(b) back up rolls allocated to and providing lateral support for the work rolls;

(c) support beams each of which supports one of the back up rolls;

(d) a plurality of force generation devices arranged along said back up rolls, said force generation devices acting on said support beams, each of said force generation devices being individually adjustable in such way as to provide an adjustable whipping of its respective back up roll and work roll via its support beam, wherein said back up rolls, said support beams and said plurality of force generation devices are aligned with each other so as to exert forces on said work rolls in line with said force generation devices;

(e) a chock with support or intermediate rolls, said chock being slidable into and out of the roll stand along a longitudinal direction of said chock, each support or intermediate roll being associated with and supporting one of said work rolls along a direction which is essentially perpendicular to a movement direction of a metal strip passing through the roll stand;

(f) said force generation devices positioning said back up rolls from an idle position in which said back up rolls are located outside a region where the chock moves during slide-in or withdrawal, to an operating position in which the back up rolls press against the work rolls.

2. The roll stand according to claim 1, wherein the force generation devices are hydraulically or pneumatically operable actuating cylinders.

3. The roll stand according to claim 1, wherein the force generation devices are mechanically adjustable spindles.

4. The roll stand according to calim 1, further comprising a bearing arrangement in which the back-up rolls are supported, at least in certain sections along their longitudinal extensions, by the support beam.

5. The roll stand according to claim 4, wherein the bearing arrangement comprises at lease one hydrostatic bearing.

6. The roll stand according to claim 4, wherein the bearing arrangement comprises roller bearing which are arranged so as to be regularly spaced apart along the back-up rolls.

7. The roll stand according to claim 1, wherein the support beams comprise first and second detachably interconnected components aligned in a longitudinally direction of the back-up rolls, the first component bearing against he back-up roll and the second component being coupled to the force generation device associated with the back-up rolls.

8. The roll stand according to claim 7, wherein the first component is connected to the second component of the support beam so as to be slidable along a longitudinal direction of said first component.

* * * * *